US005349996A

United States Patent [19]

McGregor

[11] Patent Number: 5,349,996

[45] Date of Patent: Sep. 27, 1994

[54] BAG FILLING APPARATUS HAVING DUST-TIGHT SPOUT

[76] Inventor: Harold R. McGregor, 645 Riverwood Dr., Owatonna, Minn. 55060

[21] Appl. No.: 919,934

[22] Filed: Jul. 27, 1992

[51] Int. Cl.[5] ..... B65B 1/04

[52] U.S. Cl. ..... 141/314; 141/10; 141/313

[58] Field of Search ..... 141/10, 314, 313, 311 R, 141/368, 371, 377; 248/99, 100, 101; 16/375

[56] References Cited

U.S. PATENT DOCUMENTS

| | | | |
|---|---|---|---|
| 3,187,372 | 6/1965 | Parsons | 16/375 |
| 4,322,932 | 4/1982 | McGregor | 53/505 |
| 4,396,189 | 8/1983 | Jenkins | 482/71 |
| 4,526,214 | 7/1985 | McGregor | 141/314 |

FOREIGN PATENT DOCUMENTS

| | | | |
|---|---|---|---|
| 105827 | 11/1938 | United Kingdom | 141/114 |

*Primary Examiner*—Henry J. Recla
*Assistant Examiner*—David J. Walczak
*Attorney, Agent, or Firm*—Moore & Hansen

[57] ABSTRACT

A bag filling apparatus including a clam-jaw spout having an inner liner and interior chute suspended beneath a hopper. The bottom end of the inner liner is pleated, and a pair of air jets disposed on opposing sides of the liner project a stream of air toward each concave side of the liner ensuring a uniform and repeatable fold and substantially dust-tight seal as the clam-jaw sections of the spout begin to close. The oval shape of the dust collectors and increased cross-sectional area of the ports and conduits increases the volume of air and amount of airborne particulate matter withdrawn from above the top of the bag without unduly increasing the flow velocity of the air through those ports, and without requiring separate air removal means disposed within the interior of the bag. Lateral movement of the bag gripping members toward the spout is controlled and limited by contact between the external side wall of the dust collectors and adjustable cushions disposed on the arms supporting the bag gripping members. The height of the bag gripping members relative to the bottom of the spout is adjusted using slots within the support plate, and the range of opening motion of the bag gripping arms is controlled by stops located on the support plate.

3 Claims, 4 Drawing Sheets

BAG FILLING APPARATUS HAVING DUST-TIGHT SPOUT

BACKGROUND OF THE INVENTION

This invention relates generally to bag filling machines for filling fine particulate powder into bags, and particularly to a dust-tight spout assembly having a vacuum discharge and a bag gripping assembly.

U.S. Pat. No. 4,526,214 to McGregor discloses a bag filling apparatus having a spout (2) incorporating two clam-jaw sections (4, 6) and an inner flexible tubular liner (122), and having a pair of dust collectors (88, 90) disposed on each side of the spout. Such an assembly is preferably utilized with the forming bars of the type shown in the bag hanging and gripping assembly disclosed in U.S. Pat. No. 4,322,932 to McGregor, although components of the bag gripping assembly are mounted on the spout as shown in the McGregor '214 patent.

In the McGregor '214 patent, the dust collectors are located in fluid flow communication with the interior of the suspended bag (140) adjacent the top end thereof, and are disposed overlying the open gap formed by the top of the bag between the gripping members (66, 68) and the side wall of the spout (**4*a*, 4*b***).

Each of the dust collectors are characterized by generally rectangular ports (100, 102) along the bottom edges thereof, with interior bodies defined and enclosed by planar outer wall segments (92, 94) spaced apart from the side walls of the spout (**4*a*, 4*b*) by spacer bars (96, 98). Each dust collector thus forms a generally flat enclosure with a port disposed above the top of the bag when the clam jaw spout is in the closed position, with the dust collectors pivoting in unison with the outer section (4**) of the clam-jaw spout.

A pair of vacuum hoses (112, 114) connect each of the dust collectors to a source of negative pressure such as a vacuum pump (118). A separate vacuum line (136) is coupled to one of the vacuum hoses and connected to a passage (132) at the terminal end of the double-walled spout closure (30). The passage and spout closure extend along the entire length of the bottom edge of the clam-jam section of the spout, and the passage is located in fluid communication with the interior of the bag. Bag clamps (34, 36) hold the top edges of the bag in close contact with the bottom edge of each clam-jaw section of the spout, and are moved by double-acting power cylinders (58, 60).

The flexible tubular liner (122) is suspended within the spout and sealingly connected around the bottom opening of the hopper (1) to prevent airborne product from escaping the interior of the bag and the spout into the surrounding environment. The liner extends the height of the spout, with the bottom end of the liner received within the open top of the bag when the clam-jaw sections are open and the bag is being filled. The open bottom end of the liner is compressed together when the clam-jaw sections are closed and the bag is removed from the spout.

Each pair of gripping members (66, 68) are carded on arms (74, 76) that are pivotally mounted on opposing ends of a crossbar (75), and are pivoted inwardly toward one another and outwardly away from one another by a centrally mounted double-acting power cylinder (78) to simulate a pinching action to grip the top of the bag. Each crossbar (75) is connected to an upright member (77) which is carded on an overhead support structure that is pivotally connected to the hopper. Each set of arms on opposing sides of the spout is therefore moved laterally inwardly toward and outwardly away from the spout and dust collectors by a double-acting power cylinder that pivots the upright member (77), with the arms being moved inwardly toward the side walls of the spout as the clam-jaw sections of the spout are simultaneously opened. The extent of the lateral movement of the pair of arms is controlled by the predetermined range of movement of the double-acting power cylinder of the overhead support structure. This operation of the bag hanging and gripping mechanism is more fully depicted in the McGregor '932 patent.

While the dust-tight spout and bag handling apparatus disclosed in the McGregor '214 patent provides a suitable and workable alternative for many operations, there are some operational drawbacks presented by its structure.

The volume of air and particulate matter drawn through the dust collectors is limited by the area of the narrow rectangular ports, and the separate passage adjacent the closure is required to withdraw air from within the spout. This separate passage increases the number and size of the components disposed on the lower portion of the spout, thus affecting the capabilities of the bag hanging apparatus (and the accuracy and speed when hanging gussetted bags on a clam-jaw spout), and requiring additional vacuum line connections to that passage. The placement and movement of the bag handling assembly prevents increasing the dimensions of the dust collectors, and increasing the negative pressure of the vacuum pump can produce an unsuitable draw or flow velocity which unintentionally extracts product from within the bag as it falls from the spout or after it has settled within the bag. The number of double-acting power cylinders operating between predetermined ranges (particularly those controlling movement of the bag gripping arms) increases the complexity associated with programming the interrelated motions of the components when using an automated bag handling system. As the liner is compressed, creases and gaps may be formed between the confronting edges of the clam-jaw sections of the spout that permit product to spill from the spout and become airborne.

BRIEF SUMMARY OF THE INVENTION

It is therefore one object of this invention to design a bag filling apparatus having a clam-jaw spout and inner liner which ensures a uniform, reproducible, and substantially dust-tight seal at the bottom edge of the inner liner when the opposing clam-jaw sections are pivoted to the closed position.

It is another object of this invention to design the above bag filling apparatus such that the volume of air and airborne particulate matter that is drawn from above gaps in the top of the bag surrounding the spout may be increased substantially, without necessarily increasing the flow velocity of the air directed through the dust collection ports.

It is a further object of this invention to design the above bag filling apparatus so as to reduce the number of predetermined ranges that must be set or programmed to control the movement of the bag hanging and gripping components.

Briefly described, the bag filling apparatus of this invention comprises a clam-jaw spout having an inner liner and interior chute suspended beneath a hopper. The bottom end of the inner liner is pleated, and a pair of air jets disposed on opposing sides of the liner project a stream of air toward each concave side of the liner ensuring a uniform and repeatable fold and substantially dust-tight seal as the clam-jaw sections of the spout begin to close. The oval shape of the dust collectors and increased cross-sectional area of the ports and conduits increases the volume of air and amount of airborne particulate matter withdrawn from above the top of the bag without unduly increasing the flow velocity of the air through those ports, and without requiring separate air removal means disposed within the interior of the bag. Lateral movement of the bag gripping members toward the spout is controlled and limited by contact between the external side wall of the dust collectors and adjustable cushions disposed on the arms supporting the bag gripping members. The height of the bag gripping members relative to the bottom of the spout is adjusted using slots within the support plate, and the range of opening motion of the bag gripping arms is controlled by stops located on the support plate.

DESCRIPTION OF THE PREFERRED EMBODIMENT

Figure 1:
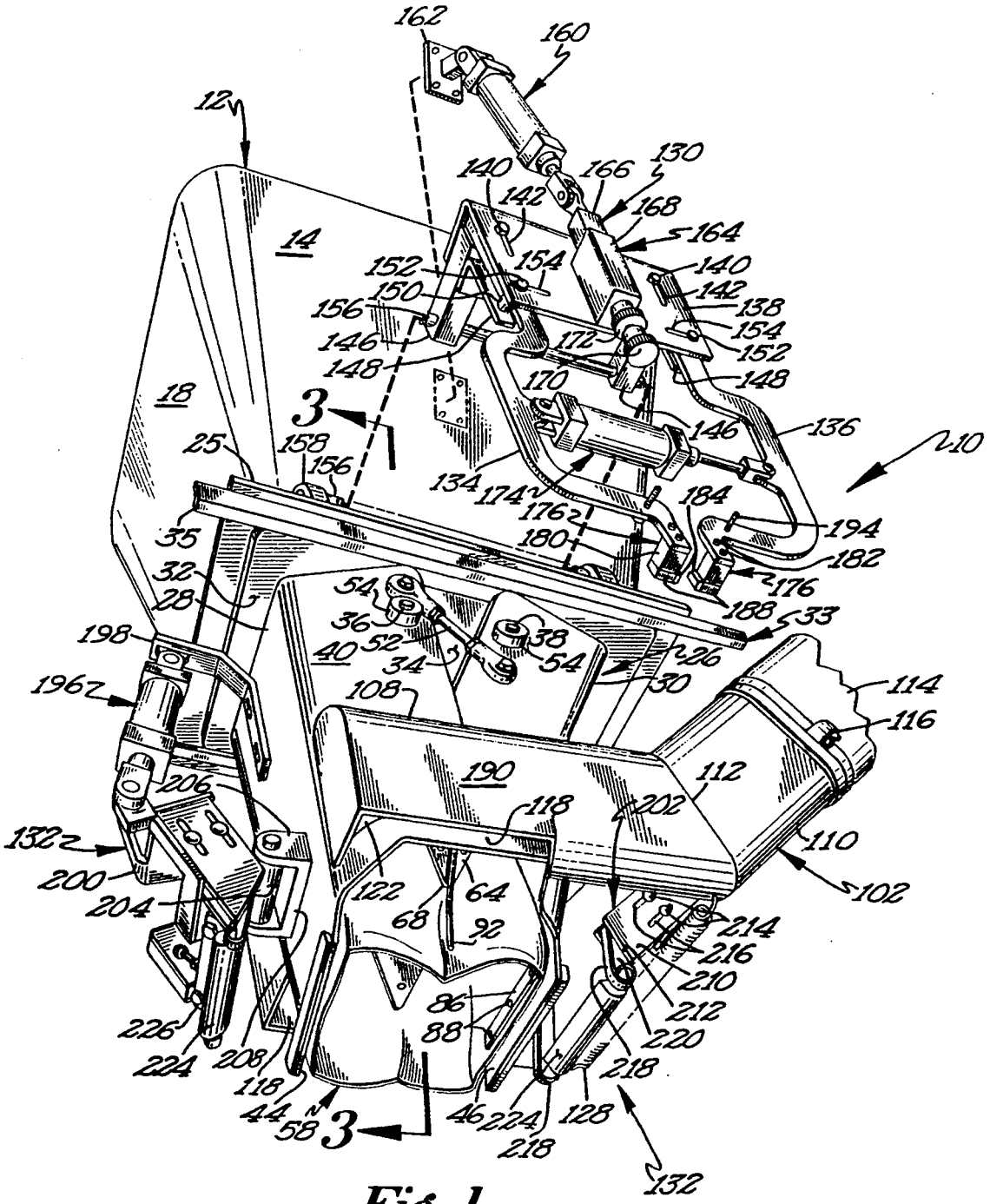
FIG. 1 is a partially exploded perspective view from below of the bag filling apparatus of this invention including portions of the hopper, clam-jaw spout, inner liner, dust collectors, one bag gripping assembly, and two bag clamping assemblies.

The bag filling apparatus of this invention is shown in FIGS. 1- and referenced generally therein by the numeral 10. To the extent that various components of the bag filling apparatus 10 of this invention are disclosed and further described in U.S. Pat. Nos. 4,526,214 and 4,322,932 to McGregor, the specifications of those patents are incorporated herein by reference as though recited in their entirety.

Figure 2:
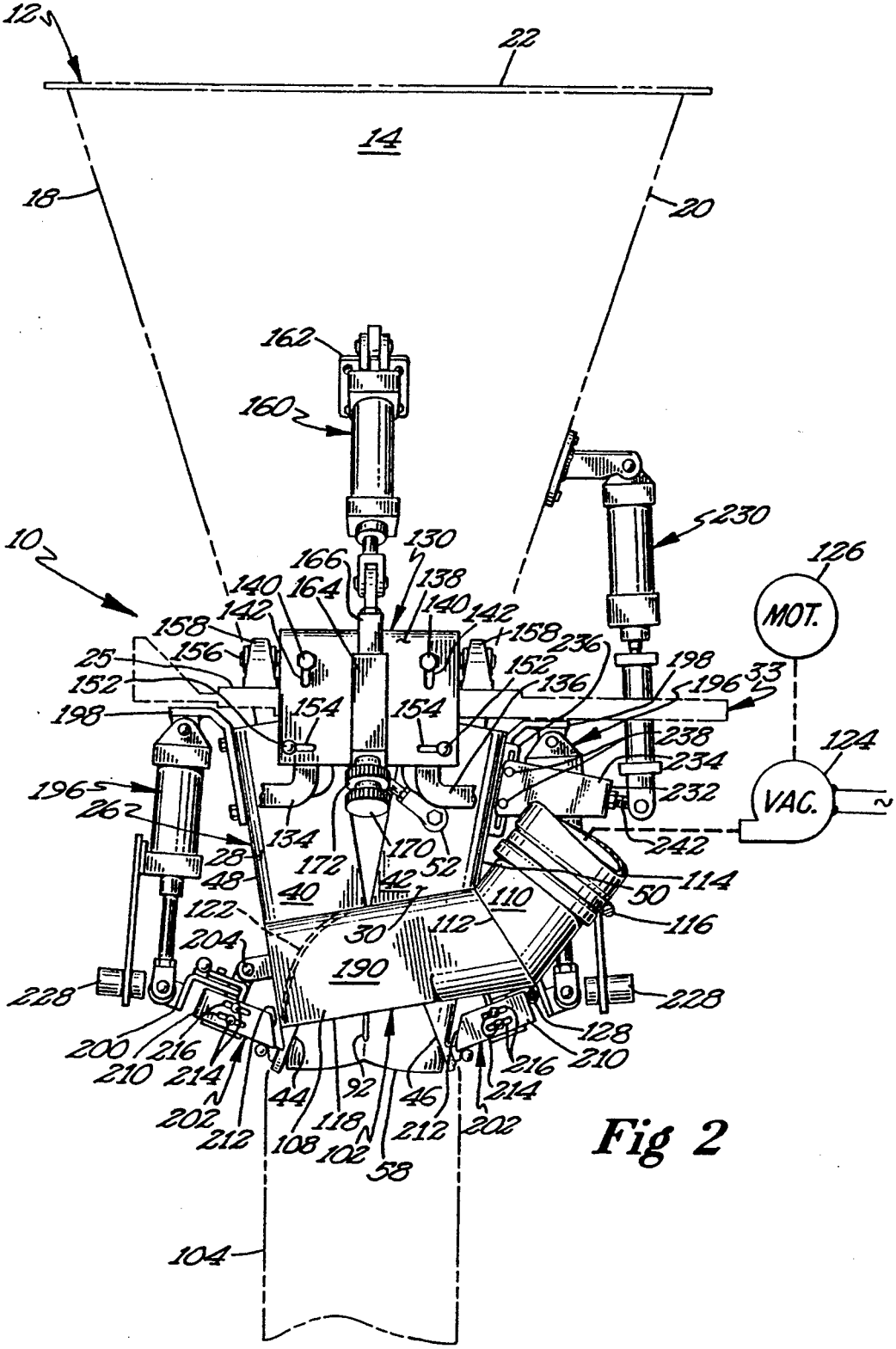
FIG. 2 is a side elevation view of the bag filling apparatus of FIG. 1.

Referring particularly to FIGS. 1 and 2, the bag filling apparatus 10 includes a tapered rectangular hopper 12 having two pair of opposing walls designated as side walls 14, 16, a front wall 18, and a rear wall 20, a top rim 22 defining an opening, and a bottom rim 24 defining an outlet. The hopper 12 may be supported from above on a frame (not shown) as well as fully or partially supported from below by an intermediate frame member 25 or plate that defines a central aperture (not shown) to communicate with the outlet of the hopper 12.

Figure 4:
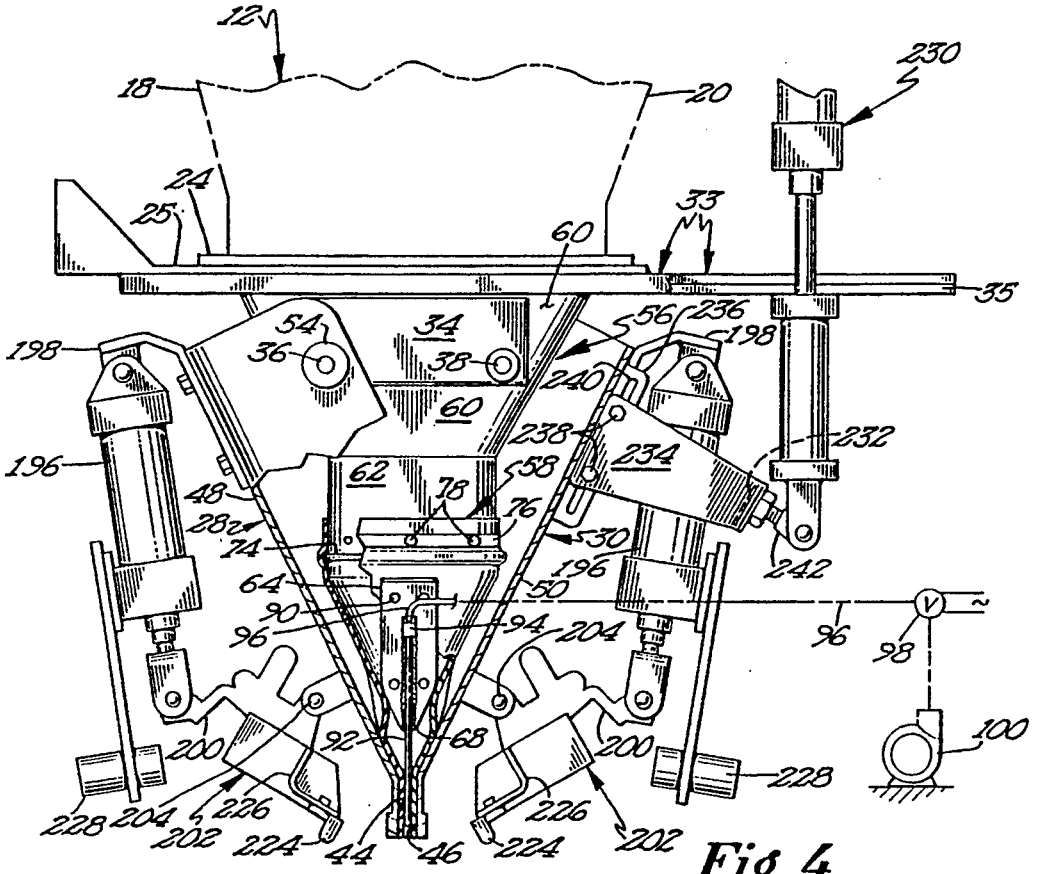
FIG. 4 is a partially broken away side cross section view of the bag filling apparatus of FIG. 1 taken through line 4—4 of FIG. 3.

A spout 26 of the clam-jaw type including a pair of opposing pivotable clam-jaw sections 28, 30 is mounted beneath the hopper 12, the spout 26 including a top peripheral flange 32 which flares horizontally outward to mate and align with the bottom of the hopper 12 and a generally rectangular collar 34 depending from the peripheral flange 32. The spout 26 is suspended beneath the hopper 12 on and between a pair of L-shaped support rails 33 that extend beyond the front and rear edges of the intermediate frame member 25, with the peripheral flange 32 of the spout 26 being slidably inserted between the support rails 33 and resting on and above the inwardly projecting portions 35 thereof, and securely fastened in the selected position by a plurality of threaded fasteners (not shown). The flange 32 of the spout 26 is also connected directly to the intermediate plate 25 using a plurality of threaded fasteners (not shown) to maintain the spout 26 in the proper aligned position with the outlet of the hopper 12. Referring to FIG. 4, it may be seen that the support rails 33 preferably extend forwardly or rearwardly beyond the front or rear edge of the intermediate plate 25 sufficient to permit the spout 26 to be unfastened from the intermediate plate 25 and suspended from the support rails 33 and moved slidably along the support rails 33 to a position remote from the outlet of the hopper 12, to facilitate cleaning, adjustment, modification, or repair to components of the spout 26 or within the hopper 12.

Each of the opposing clam-jaw sections 28, 30 are pivotably fastened to the collar 34 using a pair of pin connections 36, 38 disposed on each side of the spout 26, with the U-shaped top segments of the clam-jaw sections 28, 30 being positioned so that the outer planar walls 40 of one clam-jaw section 28 are on the outside of the outer planar wails 42 of the remaining clam-jaw section 30. The bottom segments of the clam-jaw sections 28, 30 are angled or tapered such that the generally vertical or upright inner edges 44, 46 mate when the clam-jaw sections 28, 30 are pivoted to the closed position as shown in FIG. 4, and form a generally acute angle relative to one another when the clam-jaw sections 28, 30 are pivoted to the completely open position as shown in FIGS. 1 and 2 with the front and rear walls 48, 50, respectively, of the clam-jaw sections 28, 30 oriented generally vertically. A connecting rod 52 or adjustable turnbuckle pivotally connected at opposing ends to each of the clam-jaw sections 28, 30 (one above and one below the corresponding pin connections 36, 38) to contact cylindrical pads 54 on each of the pin connections 36, 38 to coordinate the pivotal movement of the clam-jaw sections 28, 30.

Figure 3:
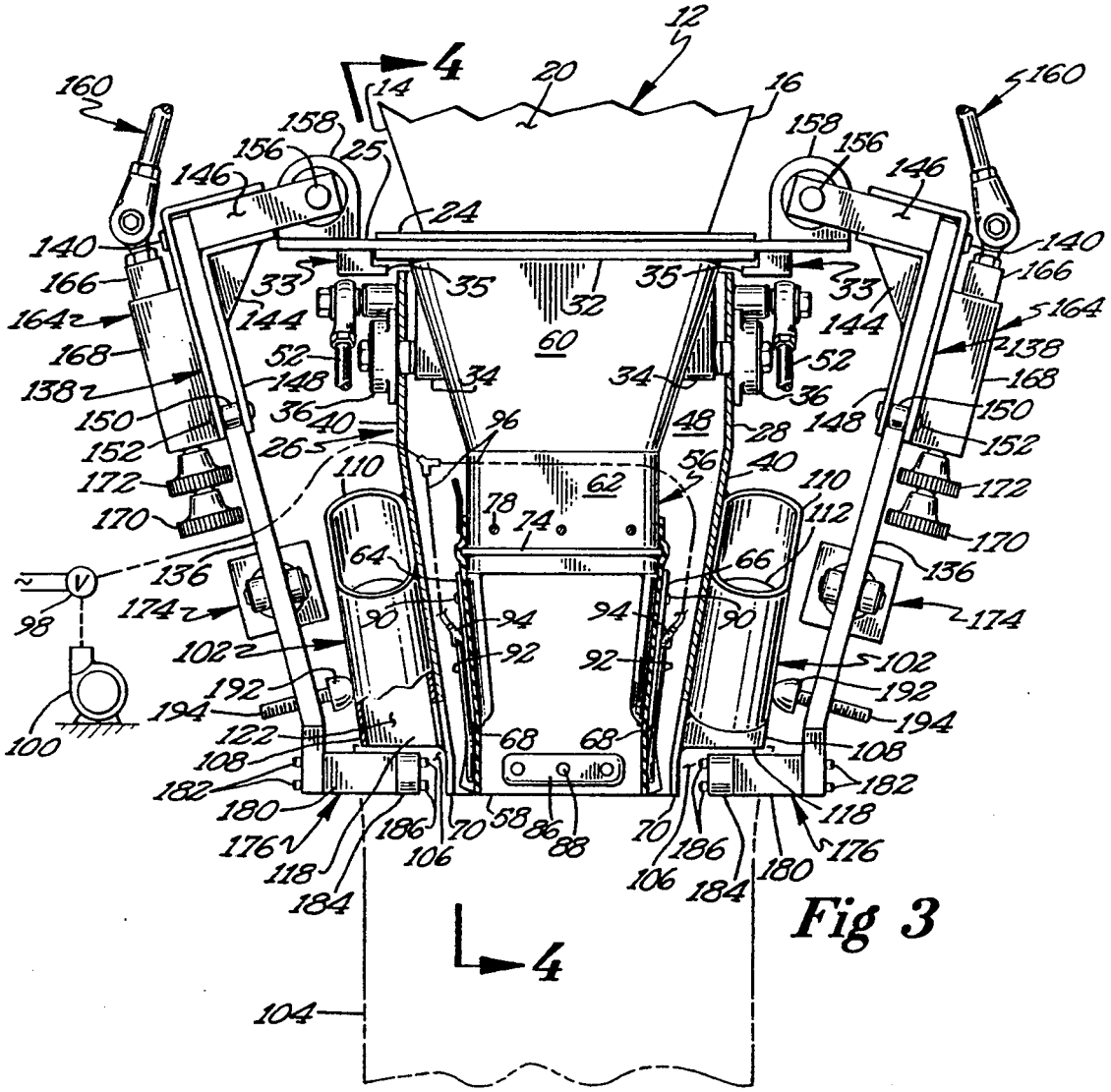
FIG. 3 is a partially broken away rear elevation view of the bag filling apparatus of FIG. 1 taken through line 3—3 of FIG. 1.

Referring to FIGS. 1, 3, and 4, it may be seen that an interior chute 56 and flexible tubular inner liner 58 are suspended from the peripheral flange 32 and rectangular collar 34. The interior chute 56 has a generally rectangular horizontal cross-section throughout, and is composed of a tapered upper segment 60, an intermediate segment 62 having upright or generally vertical side walls, and a pair of inverted triangular-shaped projections 64, 66 parallel with one another along opposing sides of the spout 26 and positioned adjacent to the side walls 40, 42 of the clam-jaw sections 28, 30 with the radiused distal tips 68 positioned at or slightly above the bottom edges 70, 72 of the corresponding clam-jaw sections 28, 30.

The tubular inner liner 58 if fabricated from any suitable flexible rubber or plastic sheet material and similarly has a generally rectangular horizontal cross-section throughout. The top region of the inner liner 58 is mounted in circumscribing relation to the intermediate segment 62 of the interior chute 56 at a point above a bead 74 which extends outward from and around the intermediate segment 62, and is held in position depending from the interior chute 56 by retaining bars 76 fastened to bolts 78 which are fixedly attached to and extend outwardly from the sides of the intermediate segment 62 and through apertures punched in the inner liner 58.

Figure 5:
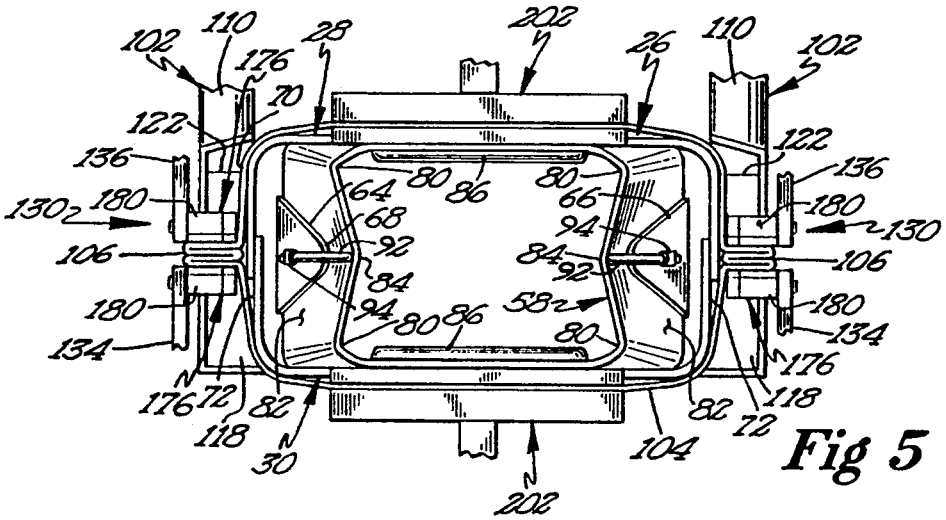
FIG. 5 is a bottom view of the clam-jaw spout and inner liner of the bag filling apparatus of FIG. 1, with the opposing clam-jaw sections in the open position.

Referring to FIGS. 1 and 5, the lower portion of the inner liner 58 defines a square or double pleat characterized by four outer corners 80 and two opposing concave side regions 82 each having a creased or scored vertical centerline 84. The two sides of the inner liner 58 defining the concave regions 82 are disposed closely proximate to and parallel with the inverted triangular-shaped projections 64, 66 of the interior chute 56, with the distal tips 68 of the inverted triangular-shaped projections 64, 66 each confronting the vertical centerline 84 of one of the concave regions 82 of the inner liner 58. The two sides of the inner liner 58 extending between the concave regions 82 are attached to the inner surface of the adjacent clam-jaw sections 28, 30 substantially along the lengths thereof using a pair of generally inert plastic or rubber bars 86 having curved outer faces and threaded fasteners 88 recessed into the bars 86.

Figure 6:
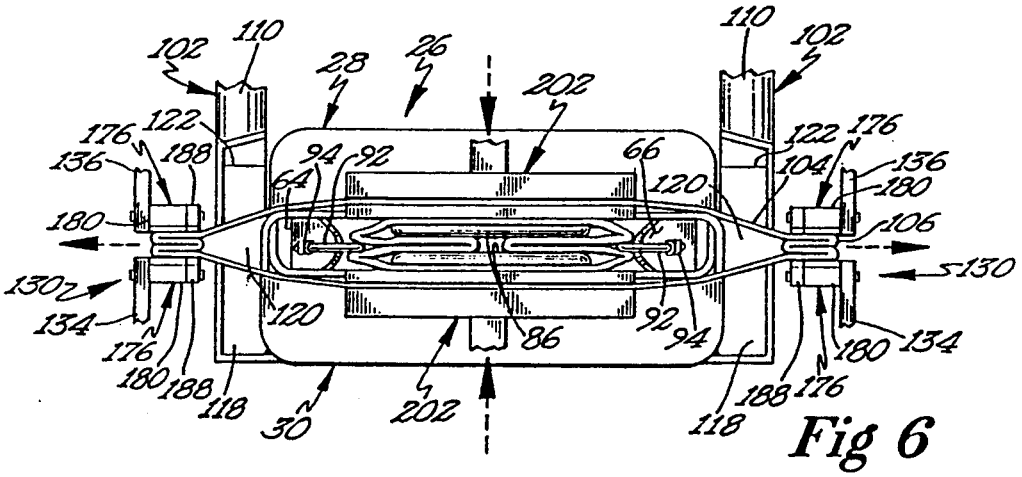
FIG. 6 is a bottom view of the clam-jaw spout and inner liner of the bag filling apparatus of FIG. 1, with the opposing clam-jaw sections nearing the closed position.

Fixedly attached to the outer surface of each inverted triangular-shaped projection 64, 66 is a mounting bracket 90 and an air jet tube 92, each air jet tube 92 being oriented generally vertically and extending along the corresponding vertical centerline 84 of the adjacent concave region 82 of the inner liner 58, with the distal or lower end of each air jet tube 92 being positioned slightly above the lower or bottom end of the inner liner 58. Each air jet tube 92 includes an orifice positioned along the radially side thereof facing the inner liner 58 and designed to project a stream of air against each concave region 82 of the inner liner 58. The air jet tubes 92 may be constructed in any suitable manner, however sections of brake line that are capped and sealed with a small orifice drilled in the radial sidewall have proven effective. The top end of each air jet tube 92 is fitted with a coupling 94 to which a section of flexible tubing 96 is attached, each section of tubing 96 in turn being connected to an electronically operated solenoid valve 98 and a compressor or other air pressure supply 100. The air pressure and solenoid valve 98 are adjusted such that a stream of air is projected from the orifice of each air jet tube 92 toward each concave side 82 of the inner liner 58 as the clam-jaw sections 28, 30 of the spout 26 begin to close to ensuring that the concave sections 82 fold completely and uniformly inwardly along the corners 80 and along the vertical centerlines 84 to repeatably produce a smooth substantially dust-tight seal along the bottom edge of the inner liner 58. Referring to FIG. 6, the clam-jaw sections 28, 30 are shown nearing the completely closed position. In the completely closed position, the curved faces of the plastic or rubber bars 86 would be compressed into the inner liner 58, and the pleated folds of the inner liner 58 would also be compressed so that the outer surfaces of the two halves of the concave regions 82 would be parallel to and contacting one another. The inner surfaces of the two halves of the concave regions 82 would be parallel to and contacting the inner surfaces of the sides of the inner liner 58 extending between the corners 80 and concave regions 82, except where the plastic or rubber bars 86 are disposed. In addition, portions of the inner surfaces of the opposing sides of the inner liner 58 extending between the corners 80 and the concave regions 82 and between the inner ends of and above and below the bars 86 will contact one another, so that the inner liner 58 would be completely closed and present no gaps or openings.

Referring again to FIGS. 1–3, it may be seen that a pair of dust collectors 102 are fixedly attached to the outer walls 40 of the outer clam-jaw section 28 on opposing sides thereof. The dust collectors 102 are each positioned to be disposed above the top of a bag 104 on each side of the spout 26 in the area between the pleated gusset 106 of the bag 104 and the outer wall 40 of the outer clam-jaw segment 28, as shown also in FIGS. 5 and 6, when the bag 104 is mounted in hanging configuration on the spout 26 in either the open position or closed position.

Each dust collector 102 is fabricated from first section 108 of 4" diameter steel tubing flattened to an oval having a width of approximately 2.5" and a height of approximately 4.9", with each end of the oval having approximately a 1.5" radius, to provide a cross-sectional area of approximately 10.9 square inches therealong. The first section 108 extends rearwardly from a point adjacent to the front side 48 of the outer clam-jaw section 28, and a second section 110 of tubing is joined to the rear end of the first section 108 at an approximately a 45° angle along a welded seam 112, with the second section 110 of tubing extending upwardly from the first section 108 and flaring outwardly to a circular cross-section proximate to the upper end thereof. A length of flexible conduit 114 is connected in dust-tight fiuid communication with the rear end of each second section 110 of tubing of the dust collectors 102, using and suitable clamping or fastening device 116.

Each dust collector 102 defines a generally rectangular or trapezoidal port 118 extending along the underside of the first section 108 of tubing disposed closely adjacent to and above the top of a bag 104 on each side of the spout 26 in the area between the pleated gusset 106 of the bag 104 and the outer wall 40 of the outer clam-jaw segment 28, and fluidly communicating with any gaps 120 or openings in the top of the bag 104 formed therebetween. Each port 118 extends along the width of the side wall 40 of the clam-jaw section 28 and has a cross-sectional area of approximately 12.9 square inches*, thus representing an increase of approximately three or more times over the cross-sectional area of the narrow ports shown in McGregor '214. For most applications, a pair of ports 118 having a cross-sectional area of less than 15 square inches will be satisfactory. A curved or arcuate partition 122 may be disposed within each of the dust collectors 102 above the ports 118 to direct air or particulate matter rearwardly into the first section 108 of tubing (as shown in phantom in FIG. 2.)

The opposite end of each flexible conduit 114 is connected to a common negative pressure source such as a vacuum or exhaust fan 124 driven by a motor 126, and the conduits 114 may optionally be connected together by at an intermediate junction (not shown) prior to connection to the vacuum or exhaust 124.

Each dust collector 102 pivots with outer wall 40 of the outer clam-jaw segment 28 as the clam-jaw segments 28, 30 open and close, and the dust collectors 102 are therefore connected together using a spring 128 or other tensioning device to prevent bouncing and dampen resonant vibration of the dust collectors 102.

Referring again to FIGS. 1–4, it may be seen that the bag 104 is held in mounted in hanging relation to the spout 26 and held in position by a pair of bag gripping assemblies 130 and a pair of bag clamping assemblies 132.

Each bag gripping assembly 130 includes a pair of curved bag gripper arms 134, 136 pivotally mounted at the top end thereof on the rear side of a support plate 138. The top end of each arm 134, 136 is mounted to rotate on a pin 140 or threaded fastener which extends through the support plate 138, and may be slidably repositioned within slot 142 to adjust the height of the bag griping arms 134, 136 relative to the bottom of the spout 26. The support plate 138 is mounted to a frame member 144 having two projecting legs 146 extending inwardly toward the hopper 12, and a pair of L-shaped flanges 148 extending outwardly and downwardly parallel with and behind the support plate 138. A pair of cylindrical stops 150 are mounted on pins 152 or threaded fasteners which extend between the support plate 138 and L-shaped flanges 148, and may be adjusted forward and backward within slots 154. Each of the legs 146 is pivotally mounted on an axle 156 carried between and rotatably mounted on a pair of bearings 158 which are fixedly attached to the top surface of the intermediate frame member 25.

A double-acting power cylinder 160 is connected to each one of the support plates 138 to pivot the support plates 138 on the axles 156 laterally inward and outward relative to the spout 26. Each double-acting power cylinder 160 is mounted at the top end thereof to a bracket 162 fastened to one of the side walls 14, 16 of the hopper 12 or to an overhead frame member, and at the lower end thereof to an adjustment mechanism 164 fixedly attached to the outer surface of the corresponding support plate 138. The support mechanism 164 may be any of several configurations, however it has proven suitable to use a rectangular block 166 slidably carded within a rectangular outer housing 168 that are adjusted longitudinally relative to one another using a threaded rod 170 and end grip member that is received through an aperture in the end of the housing 168 and into a threaded bore within the block 166 and maintained in the selected position using a locking collar 172 also threaded onto the rod 170 and similar is shape and design to the end grip member of the rod 170.

A double-acting power cylinder 174 is mounted between the two bag gripping arms 134, 136, with the double-acting power cylinder 174 oriented generally horizontally and each end positioned at or near the midpoint of the concavely curved bag gripping arms 134, 136 to move the arms 134, 136 inwardly toward one another to a retracted position and outwardly away from one another to an extended position.

A bag gripping member 176 is mounted to the lower or distal end 178 of each bag gripping arm 134, 136. Referring to FIGS. 1, 3, 5, and 6, the bag gripping members 176 are seen to comprise a generally rectangular spacer block 180 that is fastened to the inner face of the corresponding bag gripping arm 134, 136 by a pair of threaded fasteners 182 which extend through threaded apertures in the bag gripping arm 134, 136 and into threaded bores in the outer ends of the spacer blocks 180. An removable end cap 184 is similarly mounted to the inner end of each spacer block 180 by a similar pair of threaded fasteners 186 which extend through threaded apertures in the end caps 184 and :into threaded bores in the inner ends of the spacer blocks 180. A pair of rubber pads 188 are disposed on the inner confronting or facing surface of each of the end caps 184, and may be replaced or modified by exchanging end caps 184 having new of differently designed pads 188 fabricated from a different material, or having a different shape, area, thickness, or textured or patterned surface depending upon the type of bag 104 being utilized.

Lateral movement of the bag gripping arms 134, 136 toward the spout 26 is controlled and limited by contact between the external side walls 190 of the dust collectors 102 and one of two rounded cushions 192 fabricated from a hard rubber and mounted on the inner ends of two threaded rods 194 which are received within or through correspondingly threaded apertures defined in and extending through the bag gripping arms 134, 136 above the bag gripping members 176. The position of the innermost surface of each of the cushions 192 may be adjusted inwardly and outwardly relative to the corresponding bag gripping arm 134, 136 by rotating the threaded rods 194 within the apertures of the bag gripping arms 134, 136 to thereby adjust the lateral distance or angle each bag gripping arm 134, 136 may be pivoted inwardly toward the spout 26 to align and position the bag gripping members 176 at an optimal position depending upon the type and dimensions of the bag 104 and spout 26 being used.

Referring particularly to FIGS. 1, 2, and 5, it may be seen that the top edges of the bag 104 are held in sealing engagement against the outside surfaces of the clam-jaw sections 28, 30 of the spout 26 during filling of the bag 104 by the pair of bag clamping assemblies 132 mounted for movement on the corresponding clam-jaw section 28, 30.

Each bag clamping assembly 132 includes a double-acting power cylinder 196 pivotally mounted at the top end thereof to an angled bracket 198 which is fixedly attached to and extends perpendicularly outward from the front or rear wall 48, 50, respectively, of the corresponding front or rear clam-jaw section 28, 30. The lower end of each double-acting power cylinder 196 is pivotally connected to the forwardly or rearwardly extending arm 200 of a carriage 202 that is pivotally mounted on an axle 204 which extends between the opposing tangs 206 of a U-shaped mounting bracket 208 that is fixedly attached to the front or rear wall 48, 50, respectively, of the corresponding front or rear clam-jaw section 28, 30. Each carriage 202 includes a pair of end blocks 210 having tapered leading edges 212 and slidably mounted at each end of the carriage 202 using a pair of threaded fasteners 214 received and movable within a pair of parallel slots 216. Each end block 210 includes a curved spring member 218 fabricated from a flat strip of metal received and fixedly attached at the proximal end thereof within a groove or channel 220 in the leading edge 212 of the block, and defining a circular loop 222 at the distal end thereof which contacts the bag 104 when the clam-jaw sections 28, 30 are moved to the closed position. The center portion of each carriage 202 includes a hard rubber clamps 224 or pads mounted on the inner or leading edge of a bracket 226 slidably mounted on the carriage 202 to be movable inwardly and outwardly toward or away from the front or rear wall 48, 50, respectively, of the corresponding front or rear clam-jaw section 28, 30. Pressure and motion sensors 228 mounted at the lower end of plates 30 depending from the double-acting power cylinders 196 and adjacent the brackets 226 on which the clamps 224 are mounted to monitor the movement of and pressure exerted by the clamps 224 on the front or rear wall 48, 50, respectively, of the corresponding front or rear clam-jaw section 28, 30 when in the extended or clamped position and the position of the carriage 202 when in the retracted or unclamped position.

The front and rear clam-jaw sections 28, 30 of the spout 26 are pivoted inwardly and outwardly relative to one another between the open and closed positions by a pair of double-acting power cylinders 230. Each double-acting power cylinder 230 is pivotally mounted at the top end thereof to a bracket (not shown), and at the lower end to the leg 232 of a tapered L-shaped bracket 234 that is in turn slidably attached to a tang 236 extending from the front or rear wall 48, 50 of the corresponding front or rear clam-jaw section 28, 30. The height of the L-shaped bracket 234 relative to the corresponding front or rear wall 48, 50 may be adjusted using the threaded fasteners 238 extending through the L-shaped bracket 234 received and movable within a pair of parallel slots 240 in the tang 236. An eyelet 242 having a threaded end extends through the leg 232 of the L-shaped bracket 234, with the lower end of the double-acting power cylinder 230 coupled to the eyelet 242.

Each of the four sets of double-acting power cylinders 160, 174, 196, and 230 are preferably of the pneumatic-type and are operatively connected to a supply of air pressure and controlled via a centralized processor programmed to time or interrelate and synchronize the extension or retraction of each set of double-acting power cylinders 160, 174, 196, and 230 and the associated components relative to one another in the normal operation of the bag filling apparatus 10.

While the preferred embodiment of the above bag filling apparatus 10 has been described in detail with reference to the attached drawing Figures, it is understood that various changes and adaptations may be made in the bag filling apparatus 10 without departing from the spirit and scope of the appended claims.

What is claimed is:

1. In a bag filling machine for filling a product into a bag having an interior region and a generally open top and a top edge, said bag filling machine being of a type having a hopper, a spout suspended beneath said hopper onto which said bag is mounted, a bag gripping assembly for maintaining said bag on said spout, and at least one dust collector disposed between said bag gripping assembly and said spout, said bag gripping assembly having a pair of bag gripping arms including a pair of bag gripping members for gripping said top edge of said bag, said pair of bag gripping arms being mounted for pivotal movement in a lateral direction toward and away from said spout, said dust collector having an outer surface disposed opposing said spout, the improvement comprising:

at least one cushion, said cushion being connected to at least one of the pair of bag gripping arms and oriented such that said cushion contacts the outer surface of the dust collector when the pair of bag gripping arms are moved laterally toward the spout, whereby the contact between the cushion and the outer surface of the dust collector controls and limits a maximum extent of the lateral movement of the pair of bag gripping arms toward the spout, wherein the at least one cushion is mounted for movement relative to the bag gripping arms such that the bag gripping arms are displaced a predetermined distance from the outer surface of the dust collector when the pair of bag gripping arms are moved the maximum extent laterally toward the spout, and such that said predetermined distance may be selectively adjusted by moving the at least one cushion relative to the bag gripping arms.

2. The bag filling machine of claim 1 wherein the at least one cushion is carded on a rod, and wherein at least one of the pair of bag gripping arms defines an aperture, said rod extending at least partially through said aperture and being movable relative to the pair of bag gripping arms.

3. The bag filling machine of claim 2 wherein the rod is threaded and the aperture is threaded so as to mate with the rod, and wherein the rod may be rotated within the aperture to move the rod relative to the pair of bag gripping arms.

* * * * *